US009655804B2

(12) United States Patent
Guerre-Chaley

(10) Patent No.: US 9,655,804 B2
(45) Date of Patent: May 23, 2017

(54) KNEE-SUPPORTING WALKING AID

(71) Applicant: Paul Guerre-Chaley, Boyertown, PA (US)

(72) Inventor: Paul Guerre-Chaley, Boyertown, PA (US)

( * ) Notice: Subject to any disclaimer, the term of this patent is extended or adjusted under 35 U.S.C. 154(b) by 0 days.

(21) Appl. No.: 14/527,009

(22) Filed: Oct. 29, 2014

(65) Prior Publication Data

US 2016/0120730 A1 May 5, 2016

(51) Int. Cl.

| | |
|---|---|
| ***A61H 3/00*** | (2006.01) |
| ***A45B 3/00*** | (2006.01) |
| ***A45B 7/00*** | (2006.01) |

(52) U.S. Cl.

CPC ..... *A61H 3/00* (2013.01); *A45B 3/00* (2013.01); *A45B 7/00* (2013.01); *A61H 2003/005* (2013.01); *A61H 2003/007* (2013.01)

(58) Field of Classification Search

CPC ..... A61H 2003/005; A61H 3/02
See application file for complete search history.

(56) References Cited

U.S. PATENT DOCUMENTS

| | | | | | |
|---|---|---|---|---|---|
| 2,707,962 | A * | 5/1955 | Yandow | A61H 3/00 | 135/69 |
| 4,141,375 | A * | 2/1979 | Tykwinski | 135/66 | |
| 4,411,284 | A * | 10/1983 | Opitz | 135/81 | |
| 4,763,680 | A * | 8/1988 | Acosta, Sr. | A61H 3/02 | 135/68 |
| 4,867,188 | A * | 9/1989 | Reid | 135/67 | |
| 4,958,650 | A * | 9/1990 | Dale | A45B 9/00 | 135/65 |
| 5,058,923 | A * | 10/1991 | Dale | 280/821 | |
| 5,287,870 | A * | 2/1994 | Rhodes | 135/72 | |
| 5,624,199 | A * | 4/1997 | Cheng | 403/100 | |
| 5,746,236 | A * | 5/1998 | Tilsley et al. | 135/66 | |
| 2005/0109379 | A1* | 5/2005 | Rader | 135/68 | |
| 2011/0298190 | A1* | 12/2011 | Diaz | 280/87.021 | |
| 2013/0152986 | A1* | 6/2013 | Hunter | 135/66 | |

* cited by examiner

*Primary Examiner* — David R Dunn
*Assistant Examiner* — Danielle Jackson
(74) *Attorney, Agent, or Firm* — Ryder, Lu, Mazzeo & Konieczny LLC; Joseph M. Konieczny, Sr.; Gregory J. Gore

(57) ABSTRACT

A medical device for assisting patients in walking who have sustained injury to the lower portion of their legs or feet. The device supports the patient's knee and is controlled by the patient's hand and arm. The device includes an elongate ground-engaging upright stanchion having an upwardly extending vertical axis when a user is standing. The stanchion has a top and a front, and a knee holster affixed to the top of the stanchion for receiving the user's knee. A handrail projects upwardly and frontally from a top of the holster at an angle of between 15 and 35 degrees from the vertical axis. The handrail has a hand-gripping portion located such that when gripped by the user while standing an angle of approximately 90 degrees is formed at the user's elbow between the forearm and the upper arm.

12 Claims, 3 Drawing Sheets

KNEE-SUPPORTING WALKING AID

FIELD OF THE INVENTION

The present invention relates to a medical device for assisting patients in walking who have sustained injury to the lower portion of their legs or feet. More specifically the invention relates to a crutch-like device, which supports the patient's knee and which is controlled by the patient's hand and arm.

BACKGROUND OF THE INVENTION

It is often the case that people who have injuries to one of the legs at a point below the knee require assistance walking. To meet this need knee crutches and knee canes have been devised that support the healthy knee above the injury site. These devices include, for example, U.S. Pat. No. 4,141,375 and U.S. Pat. No. 2,778,370 which exemplify these devices. These patents disclose devices that are constructed to support a portion of the patient's weight at a handgrip in the case of a cane, or a handgrip in combination with an armpit support in the case of a crutch. A problem exists with these devices, however, because they limit movement of the lower leg while it is suspended. The devices are also limiting because they require the user to lean to one side over the injured leg and in vertical alignment with the ground-engaging portion of the device because force is being applied above the knee support. This creates an awkward stance that does not mimic a normal walking posture. Also, these devices are often composed of many separate parts that in many cases are secured to the user's leg, which makes them time consuming to put on and take off. Furthermore, many knee-supporting walking aids cannot be used with a lower leg cast or a foot-disabling boot.

Therefore, a need exists in the art for a knee-supporting device that can be used by patients with foot and ankle injuries and does not display the above-described deficiencies.

SUMMARY OF THE INVENTION

In order to meet the need described above, the applicant has invented a knee-supporting walking aid, which departs from the conventional thinking that the device must also support a portion of the user's weight applied by parts of the body above the knee. The applicant has discovered that all of the user's weight may be applied at the knee so that the upper portions of the walking aid can be improved for better control of the device without regard to supporting a portion of the user's weight.

The applicant has also discovered that the greatest need for directional control of a knee-supporting aid is in the forward/backward direction and that force applied by the user in this direction is anatomically maximized when the arm of the grasping hand is at a 90-degree angle measured at the elbow. This discovery has led the applicant to devise the present device in which an upwardly-extending handrail of the device projects forwardly at an angle of approximately 25 degrees from the axis of the ground-engaging portion below the knee. This forward tilt of the handrail positions the hand and arm of the user at the desired 90-degree elbow bend while allowing a lifting force to be applied between walking steps to maintain the placement of the knee in a holster of the device.

More specifically, the applicant has devised a knee-supporting walking aid for patients with leg injuries below the knee that comprises an elongate ground-engaging stanchion having an upwardly-extending vertical axis when the user is standing, said stanchion having a top and a front. A knee holster is affixed to the top of the stanchion for receiving the user's knee. An upwardly and frontally-projecting handrail extends from the top of the holster at an angle of between 15 and 35 degrees from said vertical axis with a preferred angle of 25 degrees. The handrail has a hand-gripping portion arranged so that the user's elbow forms an angle of approximately 90 degrees between the upper arm and the forearm when the user stands. The holster is affixed to the top of the stanchion and includes a knee cradle having a bottom-most bend and two upwardly extending lateral arms. The end of each cradle arm has a socket for selectively affixing the bottom end of the handrail to the cradle, whereby the handrail may be relocated from one side of the cradle to the other. Opposite ends of a belt are attached to the cradle at the front.

The handrail has a bend located between two substantially-straight upper and lower portions of the handrail, which projects the upper portion frontally. In an alternate embodiment, angular adjustment of the handrail's frontal projection may be provided at a joint between separate upper and lower portions of the handrail. Angular adjustment is provided by an apertured yoke, which is affixed to the lower portion of the handrail. The upper portion of the handrail is attached to the yoke by fasteners passing through aligned apertures of the yoke and the handrail. Further adjustability is provided by the cradle arm sockets, which include holes at different radial and axial positions that can receive fasteners that affix the lower portion of the handrail in different angular and axial positions. Yet a third means of adjustment is provided by a moveable handgrip located at the top end of the handrail, which can be affixed at alternate axial locations.

It will be appreciated by those of skill in the art that by these mechanical relations further described and shown in the following drawings that a walking aid has been devised that provides ease of use and superior maneuverability as well as other advantages that will be appreciated when compared with the prior art. When taken in conjunction with the following drawings, this description forms a part of the specification wherein like references and characters designate corresponding parts in several views.

DESCRIPTION OF THE PREFERRED EMBODIMENT

Figure 1:
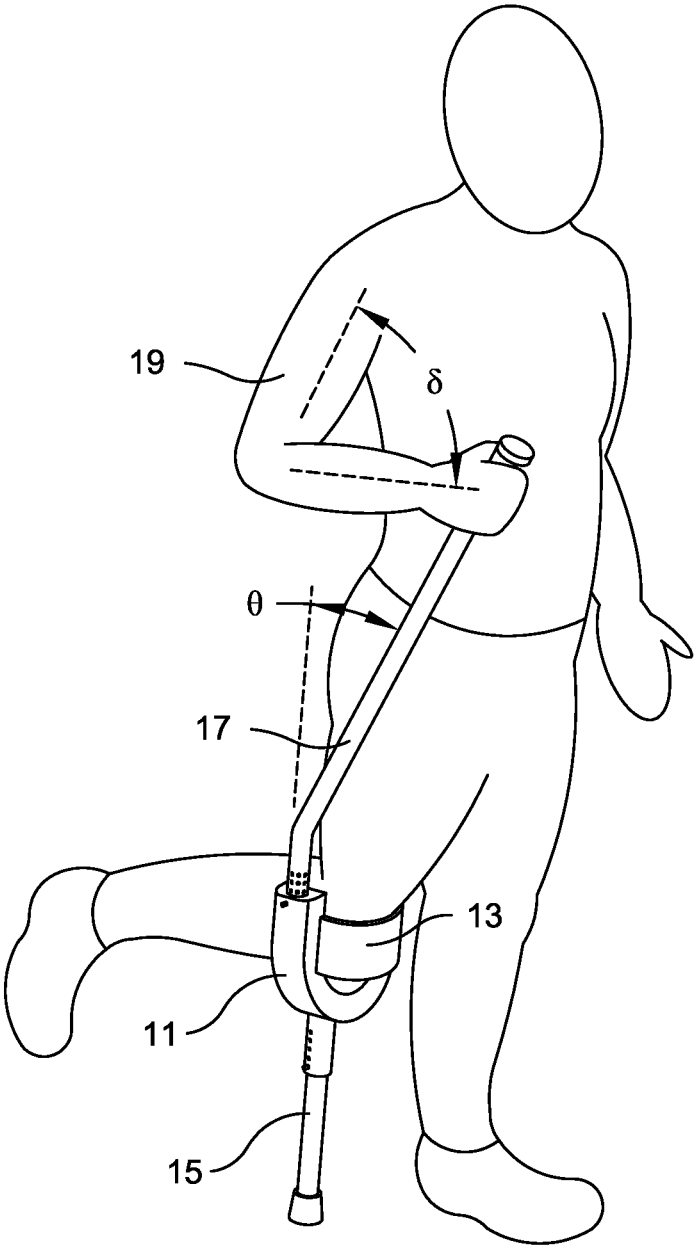
FIG. 1 is a top left front perspective view of the invention being used by a patient in a standing position.

Referring now to FIG. 1, one embodiment of the invention is shown with the user in a standing position. The knee of the right leg of the user occupies a knee holster that is comprised of a U-shaped cradle 11 and a belt 13 attached at its ends to lateral arms of the cradle across the front. An upright stanchion 15 is affixed at its top to the bottom bend of the cradle 11. Handrail 17 extends upwardly and frontally from the top of the holster. In this position one can see that the controlling arm 19 of the user forms an angle delta (δ) measured between the upper arm and the forearm. In preferred embodiments, the handle 17 is arranged so that the angle delta (δ) is approximately 90 degrees. Also, the lower leg is unconstrained.

Figure 2:
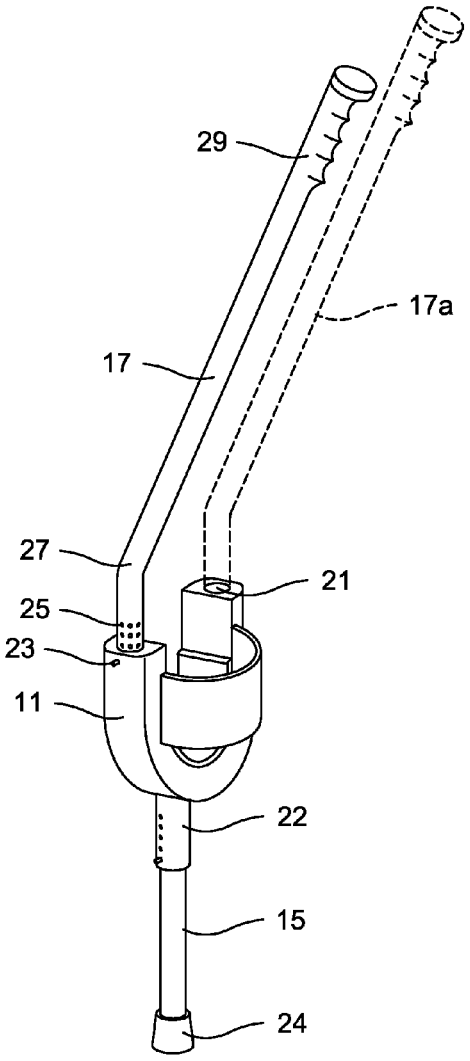
FIG. 2 is a top left front perspective view of one embodiment of the invention with an alternate location of the handrail shown in phantom.

Referring now to FIG. 2, the embodiment shown in FIG. 1 is depicted in isolation. Stanchion 15 includes height adjustment means 22 and a non-slip rubber tip 24 at the bottom. The handrail 17 has a substantially vertical lower portion below bend 27 which angles an upper portion frontally. A handgrip 29 is located at the top of the handrail. Each arm of cradle 11 includes a socket 21 that receives the bottom end of the handrail. Releasable attachment of the handrail to each socket is achieved by a removable pin 23, which is engageable with an array of axially and radially spaced holes 25 in the lower portion of the handrail 17. It will be appreciated by those of skill in the mechanical arts that by these relations the handrail 17 can be both radially and axially adjusted independently and also that the handrail can be moved from one side of the holster to the other. The alternate position 17*a* of the handrail is shown in phantom. Changing sides is necessary to accommodate either a right leg or left leg injury.

Figure 3:
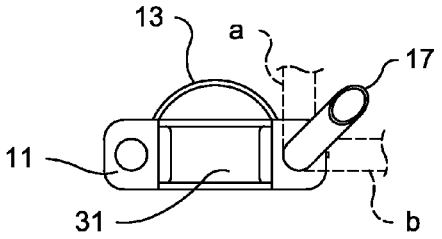
FIG. 3 is a top plan view showing the handrail in alternate radial positions with respect to the knee holster cradle.

Referring to FIG. 3, the radial adjustability described with regard to FIG. 2 is conveyed by the depiction of the alternate positions (a) and (b) of the handrail 17 shown in phantom. The inside of the base of the cradle 11 includes a cushion 31 for comfort. It will also be appreciated from this view that the area within the cradle 11 defined by the front belt 13 is limited to a small area, which permits freedom of movement of the lower leg and ease of entry and exit of the knee.

Figure 4:
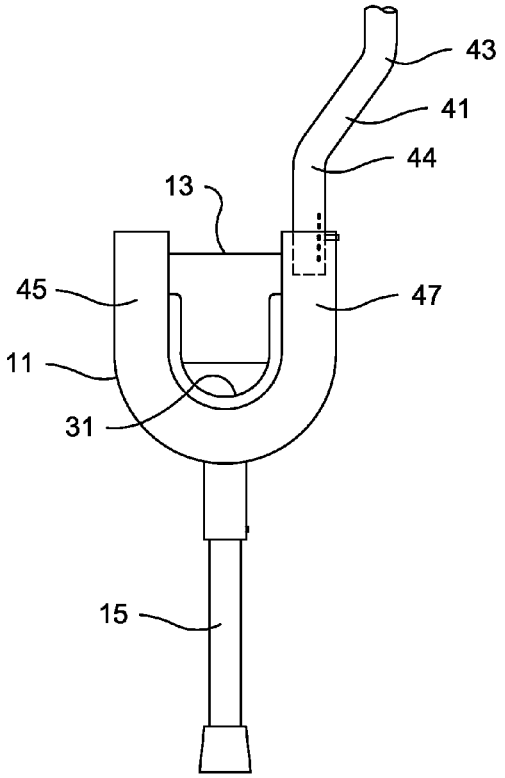
FIG. 4 is a rear elevation view showing a handrail embodiment having lateral bends.

Referring to FIG. 4, this rear view shows greater detail of the like enumerated elements described in FIGS. 1, 2 and 3 except that handrail 41 in this Figure has a pair of bends 43 and 44 which displace the upper portion of the handrail laterally. This modification may be necessary to accommodate patients having a larger-than-average girth. Arms 45 and 47 of the cradle 11 are laterally disposed.

Figure 5:
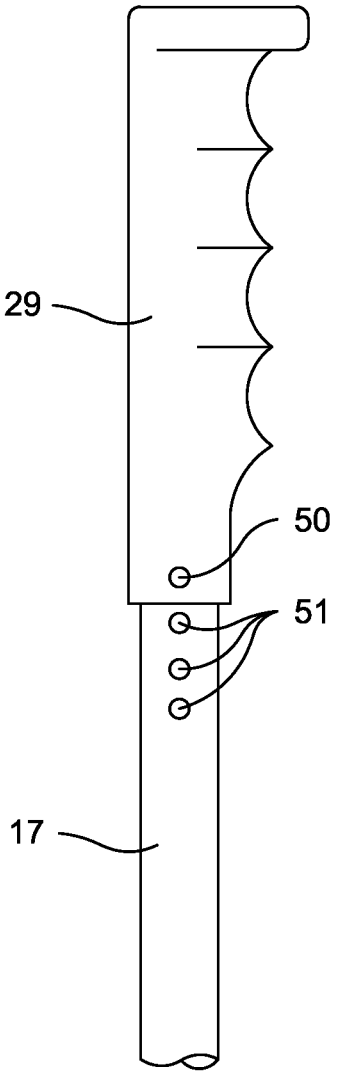
FIG. 5 is a right side elevation view of the upper portion of the handrail including a handgrip; and, FIG. 6 is a left side elevation view showing an angularly adjustable handrail joint.

Referring to FIG. 5, the handgrip 29 may also include adjustment means to move the grip to different axial positions along the handrail. In this case a pin 50 secures the grip to the handrail by passing a fastener through aligned holes 51 in the handrail 17.

Figure 6:
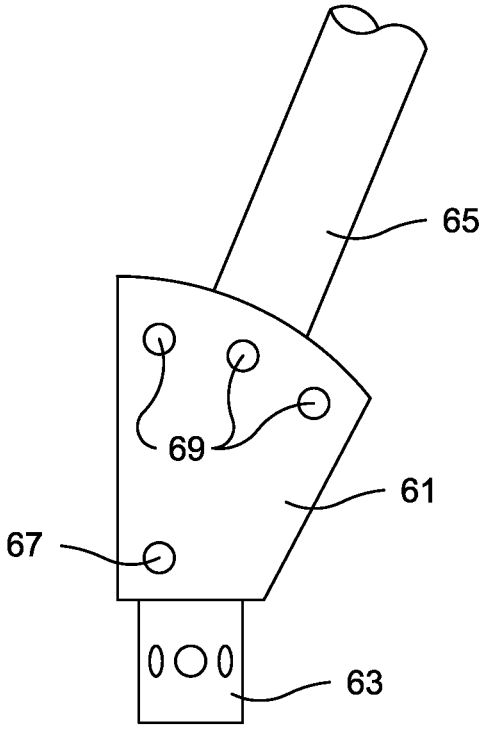

Referring to FIG. 6, an embodiment of the handrail is depicted in which the upper portion and lower portion of the handrail comprise two separate parts united at an angularly-adjustable joint. The joint allows adjustment of the angle theta (θ) at which the handrail projects frontally. This embodiment includes a yoke 61 that is rigidly affixed to a lower portion of the handrail 63. The upper portion 65 hinges at pin 67 so that a receiving hole in the upper portion can rotate into alignment with one of the three holes 69 in the yoke. A securing fastener (not shown) is passed through the aligned holes in the yoke and upper handrail portion to affix the upper portion at the desired angle. In preferred embodiments, the frontal-projection angle is about 25 degrees, plus or minus 10 degrees.

By these descriptions of the various embodiments, it will be appreciated that the present invention provides many advantages to the user. The greater control provided by the frontally projecting handrail makes it easier for the user to walk up stairs and move around in tight spaces. The ease of moving the knee into and out of the holster makes it easier to sit down and stand up and easier to get into and out of a car. Because there is no obstruction to the leg below the knee, it can be used by a patient who wears a therapeutic boot or cast. The invention has a simple construction without many pieces or moving parts. Furthermore, there are many means for adjusting the elements of the device to suit the varying needs of different users.

Other advantages of the invention will be apparent to those of skill in the art. The embodiments shown herein are for illustration only and are not intended to limit the scope of the applicant's invention, which is to be determined only by the following claims and their legal equivalents.

The invention claimed is:

1. A knee-supporting walking aid, comprising:

an elongate ground-engaging upright stanchion having an upwardly extending vertical axis when a user is standing, said stanchion having a top and a front;

a knee holster affixed directly to the top of the stanchion for receiving the user's knee;

a single upwardly and frontally projecting handrail extending from a top of the holster at an angle of between 15 and 35 degrees from said vertical axis, said handrail having a hand-gripping portion located such that when gripped by the user while standing erect an angle of approximately 90 degrees is formed at the user's elbow between the forearm and the upper arm;

wherein said holster comprises a U-shaped knee cradle having a bottommost bend for receiving the user's knee, said cradle affixed directly to the top of said stanchion in the middle of the bend and further including two upwardly extending vertical laterally disposed arms; and wherein distal ends of each of said arms include a socket for receiving a bottom end of said handrail and for releasably affixing the handrail to said cradle whereby the handrail can be relocated from one side of the holster to the other.

2. The device of claim 1 wherein the handrail includes a bend located between two substantially straight lower and upper portions of the handrail, the lower portion being vertical and the upper portion projecting frontally from said bend.

3. The device of claim 2 further including a handgrip located at the top of the upper portion of the handrail.

4. The device of claim 1 further including first adjustment means at a joint between upper and lower portions of the handrail for varying the angle of frontal projection of the upper portion.

5. The device of claim 4 wherein the first adjustment means comprises an apertured yoke affixed to said lower handrail portion, said yoke adapted for receiving a fastener through aligned holes in the yoke and a hole in the handrail upper portion.

6. The device of claim 1 wherein each of the sockets includes second adjustment means for selectively securing a handrail bottom end at different radial angles.

7. The device of claim 6 wherein the means for affixing the handrail to one or the other of the cradle sockets is an elongate fastener that is received through aligned holes in the handrail and the cradle arm.

8. The device of claim 7 wherein a bottom end of the handrail includes an array of vertically and horizontally aligned holes for attachment to one or the other of the cradle sockets.

9. The device of claim 7 further including third adjustment means on said handgrip for securing the handgrip at different axial positions on the handrail.

10. The device of claim 1 wherein the forward angle of the upper portion of the handrail with respect to the vertical axis of the stanchion is approximately 25 degrees.

11. The device of claim 1 further including a lateral extending belt affixed to said holster, said belt attached at opposite ends to the cradle arms across the front.

12. A knee-supporting walking aid, comprising:

an elongate ground-engaging upright stanchion having an upwardly extending vertical axis when a user is standing, said stanchion having a top and a front;

a knee holster affixed directly to the top of the stanchion for receiving the user's knee;

a single upwardly and frontally projecting handrail extending from the topmost end of the holster at an angle of between 15 and 35 degrees from said vertical axis, said handrail having a hand-gripping portion located such that when gripped by the user while standing erect an angle of approximately 90 degrees is formed at the user's elbow between the forearm and the upper arm;

wherein said holster comprises a U-shaped knee cradle having a bottommost cradle bend for receiving the user's knee, said cradle affixed directly to the top of said stanchion in the middle of the bend and further including two upwardly extending vertical laterally disposed arms, at least one of said arms having a socket for receiving a bottom end of said handrail.

* * * * *